United States Patent [19]

Okumori et al.

[11] 4,009,290

[45] Feb. 22, 1977

[54] METHOD FOR PREPARING EDIBLE OIL

[75] Inventors: Toshio Okumori, Sagamihara; Yozo Tadokoro, Yokohama; Yoshiyuki Takagi, Yokohama; Nobuo Yoshida, Yokohama, all of Japan

[73] Assignee: Nisshin Seiyu Kabushiki Kaisha, Tokyo, Japan

[22] Filed: Apr. 6, 1976

[21] Appl. No.: 674,121

Related U.S. Application Data

[63] Continuation-in-part of Ser. No. 441,497, Feb. 11, 1974, abandoned.

[52] U.S. Cl. ..... 426/489; 260/412.2; 260/412.4

[51] Int. Cl.[2] ..... C11B 1/06; C11B 1/10

[58] Field of Search ..... 426/417, 430, 489; 260/412.2, 412.4; 99/495

[56] References Cited

UNITED STATES PATENTS

| | | | |
|---|---|---|---|
| 2,253,696 | 8/1941 | Fauth | 260/412.2 |
| 2,505,139 | 4/1950 | Pascal | 260/412.4 X |
| 2,714,551 | 8/1955 | Pascal | 260/412.4 X |
| 2,934,431 | 4/1960 | Cavanagh | 426/417 X |

FOREIGN PATENTS OR APPLICATIONS

| | | | |
|---|---|---|---|
| 214,478 | 4/1924 | United Kingdom | 260/412.4 |
| 705,369 | 3/1954 | United Kingdom | 426/489 |

*Primary Examiner*—S. Leon Bashore
*Assistant Examiner*—Marc L. Caroff
*Attorney, Agent, or Firm*—O'Brien & Marks

[57] ABSTRACT

Oil is extracted from vegetable material, such as cottonseed, rapeseed, safflower seed, sunflower seed, and linseed, by mechanically expelling crude oil from the vegetable material and then chemically extracting crude oil from the pulp cakes produced in the expelling step by using a suitable solvent. After the expelling step the oil is separated from the cakes and, thereafter, the mechanically expelled crude oil is passed through a layer of the cakes prior to at least a portion of chemical extraction to filter fine sediment from the expelled oil and thus eliminate separate fine sediment filtering steps of the mechanically expelled crude oil.

6 Claims, 5 Drawing Figures

METHOD FOR PREPARING EDIBLE OIL

CROSS REFERENCE TO RELATED APPLICATION

This application is a continuation-in-part of our pending patent application. Ser. No. 441,497, filed Feb. 11, 1974, now abandoned which is incorporated herein by reference.

BACKGROUND OF THE INVENTION

1. Field of the Invention

The present invention relates to a process of preparing oil out of vegetable material or oil bearing seeds, such as cottonseed, rapeseed, safflower seed, sunflower seed, linseed and the like, and particularly, to a process including the combined steps of mechanically expelling oil from the seeds and chemically extracting the remaining oil from the expelled pulp or cakes by a solvent.

2. Description of the Prior Art

Referring to FIG. 1, a conventional prior art process of extracting oil out of vegetable material, such as cottonseed, rapeseed, safflower seed, sunflower seed, linseed and the like, includes both a mechanical expelling step and a chemical solvent extraction step. The oil bearing vegetable material, which is pre-treated by cleaning and cooking, is first fed into an expeller 1. A typical expeller of the continuous press type, illustrated in FIG. 4, has a truncated Archimedes screw blade 14 rotated within a mating truncated housing 15 which converges from an inlet 16 thereof to an outlet 17 thereof. The housing 15 has a large number of openings or pores in the bottom thereof opening up into a crude oil collection chamber 18. The cleaned and cooked material inserted into the inlet 16 is compressed and crushed as the material is propelled from the inlet 16 to the outlet 17 by the screw blade 14 and housing 15 to mechanically expell a large portion of crude oil from the material through the openings in the housing into the chamber 18 while the compressed cakes or pulp, still containing a large quantity of oil, is propelled out of the exit end 17 of the expeller. The mechanically expelled oil within the chamber 18 contains sediments and particles of various sizes which must be removed to produce an oil of suitable quality.

The mechanically expelled oil from the expeller 1, FIG. 1, is sequentially (a) passed to a screen tank 6 where sediments of relatively large size are separated from the crude oil, (b) transferred by a pump 7 from the tank 6 to a decanter 8 where fine sediments or sediments of relatively small size are removed, (c) transferred by a pump 9 from the decanter 8 to a tank 10 wherein the crude oil is heated to a temperature of 100° C to reduce the viscosity of the crude oil, and (d) fed by a pump 11 from the tank 10 to a filter press 12 wherein very fine sediments are separated from the oil. In the case of cottonseed oil, the heating step in the tank 10 is eliminated to prevent tinting by heating. A typical filter press of a flush plate frame type, illustrated in FIG. 3, has alternately located plates 20 and frames 21 with screening fabric 22 held between the plates 20 and frames 21. The liquid to be filtered is fed through an inlet 23 into the frames 21 to pass through the filtering fabric 22 into the plates 20 from which the filtered output, having all the sediment removed, is collected.

The compressed cakes discharged from the expeller 1 are broken into small pieces by a crushing roller 2 and then fed into a chemical extractor 3 wherein a suitable solvent is flowed through the cakes to extract the oil from the cakes. Miscella, the mixture of crude oil and solvent, from the extractor 3 is collected in a miscella tank 4 and then fed into a distiller 5 where the solvent is separated from the oil.

The decanters, filter presses, oil heating means, and various other pipings and accessories therefor, involve a considerable initial expense and subsequent maintenance and operation. Fabric filtering elements for filtering fine sediments must be cleaned periodically and such cleaning is often difficult. Also the heating of the crude oil required fro reducing the viscosity of the crude oil for filtering by the filter press 12 can deteriorate the quality of the edible oil; i.e. the crude oil when heated in contact with air can become tinted to an extent that it cannot be de-colored during subsequent de-coloring steps, and/or it is deteriorated or impaired in its flavor. Also finished oil products, particularly cottonseed oil, subjected to heating steps during the preparation process have a tendency to become tinted later during storage.

SUMMARY OF THE INVENTION

The present invention is designed for solving the various problems inherent in the prior art oil-pressing and extraction process as described above.

It is an object of the present invention to provide a process for preparing oil out of vegetable material, such as cottonseed, rapeseed, safflower seed, sunflower seed and linseed, wherein various fine filtering steps such as by decanters, filter presses and heating means are eliminated thereby saving initial cost and subsequent operating expenses as well as preventing the quality of oil from becoming deteriorated.

According to the present invention there is provided a process of preparing oil from vegetable material such as oil bearing seeds including the steps of mechanically expelling crude oil from the vegetable material, passing the mechanically expelled crude oil through a layer of cakes produced in the expelling step to filter sediment from the mechanically expelled crude oil, and chemically extracting crude oil from the cakes after the passing step by flowing a solvent through the layer of cakes.

Other objects, advantages and features of the present invention will be apparent from the following description of the preferred embodiment taken in conjunction with the accompanying drawings.

DESCRIPTION OF THE PREFERRED EMBODIEMENT

Figure 1:
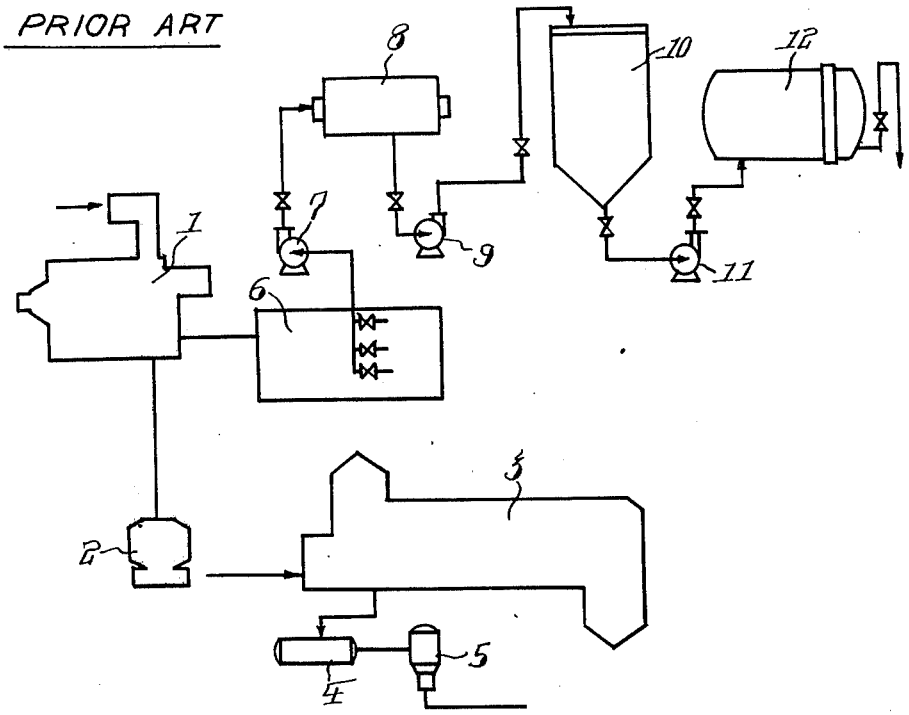
Fig. 1. PRIOR ART
FIG. 1 is a block diagram of a conventional process of extracting oil from vegetable material.
Figure 2:
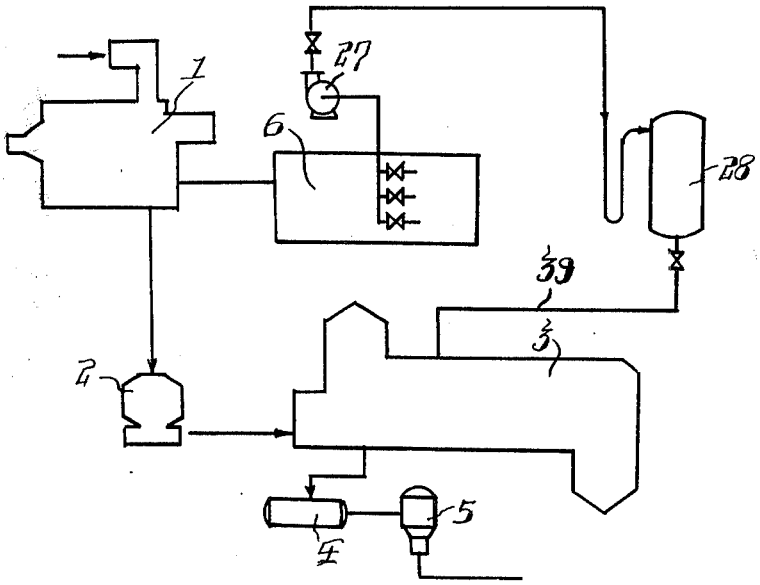
FIG. 2 is a block diagram of a novel process of extracting oil from vegetable material in accordance with the present invention.
Figure 3:
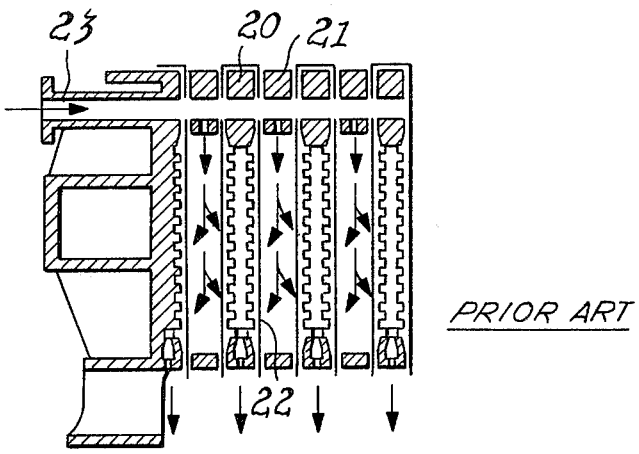
FIG. 3 is a cross-sectional diagram of a conventional filter press used in the process of FIG. 1.
Figure 4:
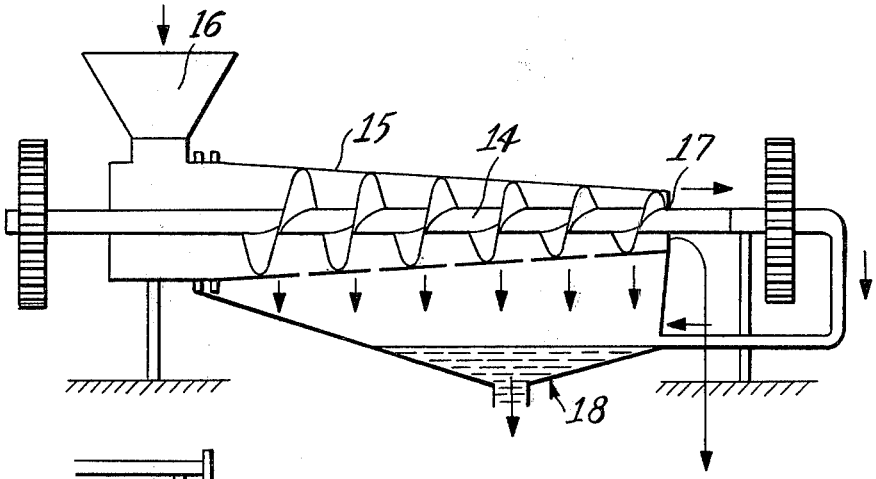
FIG. 4 is a cross-sectional diagram of a continuous expeller press used in the processes of FIGS. 1 and 2.

As illustrated in FIG. 2, a system for extracting oil in a process according to the present invention includes the expeller 1, the screen tank 6 for removing sediments of relatively large size, the crushing roller 2 downstream of the cake discharging outlet of the expeller 1, the chemical extractor 3 receiving the crushed cakes from the roller 2, the miscella tank 4 for collecting the miscella from the extractor 3, and the distiller 5 downstream from the miscella tank 4 for separating the solvent from the oil, all similar to the conventional process described in connection with FIG. 1. The decanter, heating tank and filter press of the prior art system have been eliminated and the output of the screening tank 6 is applied by a pump 27 to a service tank 28 which has its output flowing into the extractor 3 on a side where the compressed cakes are supplied. The service tank 28 serves to prevent any backward flow of the solvent into the expelled crude oil system.

Figure 5:
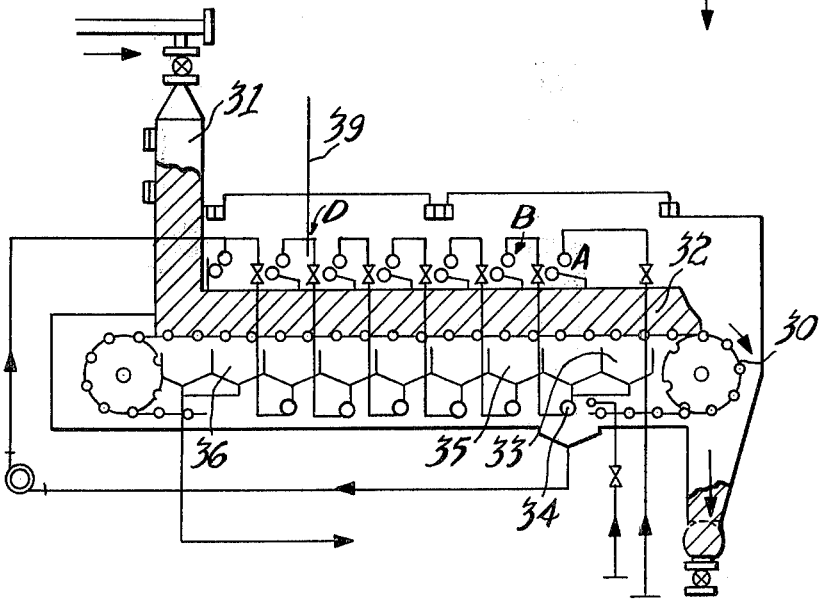
FIG. 5 is a cross-sectional diagram of a solvent extractor used in the process of FIG. 2.

The extractor, as shown in FIG. 5 has a conventional horizontal endless band conveyor 30 formed from a continuous array of perforated plates and frameworks provided with screening meshes. The crushed cakes or pulp is fed continuously from a hopper 31 to one end of the conveyor 30 to form a layer 32 of cakes about three to four feet thick which is progressed by movement of the conveyor 30 toward the other end of the conveyor. Fresh solvent, such as hexane, carbon bisulfide, benzene, benzole carbon tetrachloride, trichloroethylene, or the like, is continuously spread over a section of the layer of cakes at point A, adjacent the exit end of the conveyor 30 and then collected in a hopper 33 beneath the conveyor 30 below point A after flowing through the layer of cakes. The liquid solvent and dissolved crude oil in hopper 33 is continuously pumped by pump 34 from hopper 33 and spread over a section of the layer of cakes at point B adjacent and upstream from point A and then collected in a hopper 35 below the conveyor 30 at point B after flowing through the layer of cakes. This collection of solvent containing crude oil and spreading over adjacent upstream sections of the conveyor advanced layer of cakes is repeated many times until the final miscella is collected in a hopper 36 from whence it is discharged from the extractor 3 to the miscella tank 4 and the distiller 5. The mechanically expelled crude oil from the service tank 28 is applied to an inlet 39 and spread on top of the layer 32 at point D adjacent to the hopper 31 simultaneously with one of the last solvent applying steps. Thus the mechanically expelled crude oil is passed through the layer 32 of cakes which acts as a filter to eliminate the fine and very fine sediments from the mechanically expelled crude oil.

Since the fine sediment removing means, such as the decanter, filter press, and the crude oil tank, together with pumps, pipings and heating accessories, have been eliminated by the present process, the initial cost of the whole system as well as the labor required for operation and maintenance of the oil extraction system are substantially reduced. Further the quality of the oil in flavor and lightness is substantially increased since heating while in contact with air has been eliminated in the production of the oil; this advantage is particularly distinct for cottonseed oil which is greatly deteriorated by the heating gap. Subsequent de-coloring is simplified since tinting due to heating is absent, and tinting during storage will not occur. Also the meal product is the same in quality as that produced by prior art processes.

Since many modifications, variations and changes in detail may be made to the above described process, it is intended that all matter contained in the foregoing description and shown in the accompanying drawings be interpreted as illustrative and not in a limiting sense.

What is claimed is:

1. A process of extracting oil from vegetable seeds comprising the steps of mechanically expelling crude oil from the vegetable seeds to produce vegetable seed cakes and mechanically expelled crude oil, separating the mechanically expelled crude oil from the cakes, passing the separated mechanically expelled crude oil through a layer of the separated cakes produced in the expelling step to filter sediment from the mechanically expelled crude oil, and chemically extracting crude oil from the cakes after said passing step is performed by flowing a solvent through the layer of cakes.

2. A process as claimed in claim 1 in which said layer of cakes is moved on a conveyor during said passing and chemical extraction steps with the passing step being performed at a point along the conveyor upstream of where the chemical extracting step is performed.

3. A process as claimed in claim 2 wherein the chemical extraction step includes a plurality of repetitive flowing steps wherein the solvent is flowed through respective successive sections of the layer of cakes beginning adjacent the downstream end of the conveyor, and the passing step occurs simultaneously with one of the flowing solvent steps adjacent the upstream end of the conveyor.

4. A process as claimed in claim 3 including the step of collecting the mechanically expelled crude oil oil in a service tank prior to combining the separated mechanically expelled crude oil with the cakes to prevent a backflow of solvent into the crude oil.

5. A process as claimed in claim 4 including the step of filtering large size sediment from the separated mechanically expelled crude oil prior to the collecting step for the mechanically expelled crude oil.

6. A process as claimed in claim 1 wherein the seed is selected from the group consisting of cotton seed, rapeseed, safflower seed, sunflower seed and linseed.

* * * * *